US007556170B2

(12) United States Patent
Vroon

(10) Patent No.: US 7,556,170 B2
(45) Date of Patent: Jul. 7, 2009

(54) LIGHTWEIGHT STACKABLE HORIZONTAL DISPENSING CONTAINER

(75) Inventor: William J. Vroon, Holland, MI (US)

(73) Assignee: Bradford Company, Holland, MI (US)

( * ) Notice: Subject to any disclaimer, the term of this patent is extended or adjusted under 35 U.S.C. 154(b) by 873 days.

(21) Appl. No.: 10/761,013

(22) Filed: Jan. 20, 2004

(65) Prior Publication Data

US 2005/0155971 A1 Jul. 21, 2005

(51) Int. Cl.
*B65D 1/24* (2006.01)
*B65D 25/04* (2006.01)

(52) U.S. Cl. ..... 220/500; 220/1.5; 220/507

(58) Field of Classification Search ..... 220/1.5, 220/4.28, 4.33, 23.8, 503, 504, 528
See application file for complete search history.

(56) References Cited

U.S. PATENT DOCUMENTS 1,163,696 A * 12/1915 Silberman ..... 220/4.33
2,608,339 A * 8/1952 Benzon-Petersen ..... 206/583
4,172,623 A * 10/1979 Anderson ..... 312/244
4,828,132 A * 5/1989 Francis et al. ..... 220/6
4,946,036 A * 8/1990 Kupersmit ..... 206/386
4,948,005 A * 8/1990 Garton et al. ..... 220/1.5
5,320,244 A * 6/1994 Yu ..... 220/507
5,725,118 A * 3/1998 Slager et al. ..... 220/4.28
5,725,119 A 3/1998 Bradford et al.
6,062,410 A 5/2000 Bradford et al.
6,540,096 B1 * 4/2003 Bazany et al. ..... 220/6
6,648,142 B1 * 11/2003 Hugenholtz et al. ..... 206/425
6,827,231 B2 * 12/2004 Budowski et al. ..... 220/4.29

* cited by examiner

*Primary Examiner*—Harry A Grosso
(74) *Attorney, Agent, or Firm*—Wood, Herron & Evans, LLP

(57) ABSTRACT

A lightweight horizontal dispensing container comprising a pallet base, a pallet cover and a three sided sleeve of plastic material extending between the pallet base and the pallet cover may be stacked on top of similar pallet covers or below similar pallet bases. A rectangular frame is secured to the sleeve and defines an opening on a fourth side of the horizontal dispensing container. Dunnage provides horizontal access to parts inside the container. This container enables a horizontal dispensing container to be stacked above or below conventional pallet loads.

29 Claims, 8 Drawing Sheets

LIGHTWEIGHT STACKABLE HORIZONTAL DISPENSING CONTAINER

FIELD OF THE INVENTION

This invention relates generally to shipping containers used to ship products, and more particularly, to a lightweight, stackable container which may be accessed from the side on an assembly line.

BACKGROUND OF THE INVENTION

A large number of different container structures are utilized by manufacturers to ship a variety of different products to end users, which may be, for example, assembly plants. In the automobile industry for example, an assembly plant assembling a particular automobile might utilize a number of different parts from different manufacturers. These manufacturers ship their respective parts to the assembly plant in container structures where the parts are then removed from the container structure and assembled into a finished automobile.

For a variety of automobile parts, and particularly large or long parts, such as automobile door panels, steel rack structures or racks are often used for shipment. Such steel racks generally comprise an open steel frame and specially designed support structures known in the industry as dunnage which engages the frame and the parts or products simultaneously to support to product within the frame during shipment. The steel frame provides sufficient structural support during shipment to reduce or eliminate any damage to the parts in the dunnage. One such steel rack container is shown in FIG. 2.

Often the steel racks are specially designed and dimensioned for a particular automobile part. The racks may support the parts in a side-by-side fashion for easy horizontal access on an assembly line. For example, a steel rack full of parts will usually be positioned next to a particular station on an assembly line, and the line worker will remove a part directly from the rack for installation on the automobile. For easy access, the racks are often designed to be entered from the side as opposed to the top so that a user may remove parts horizontally rather than vertically as with some other containers. Horizontal removal of parts may be easier for an assembly line worker than vertical removal of parts, especially if the process is repeated many times.

Although steel racks have proven adequate for parts shipment, such racks also have various drawbacks. First, the steel racks are heavy, which makes shipping and handling more difficult, dangerous and expensive. Often times, the weight of the steel rack is far greater than the weight of the parts shipped in the steel rack. In such situations, a more lightweight, but structurally sound, shipping container in which the parts may be horizontally dispensed would be desirable.

Another drawback to steel racks is that they are expensive to fabricate and generally must be specially fabricated and fitted to hold the specific parts being shipped. They are then only adequate for containing a single part type.

For stacking purposes, some steel racks are specifically designed with a plurality of studs extending upwardly from the top which are adapted to fit into holes in the legs of another steel rack made by the same manufacturer. However, a steel rack structure made by one manufacture may not be stackable on steel rack structures made by other manufacturers. In other words, steel racks from different manufacturers may not always be stacked together. Therefore, steel racks must be returned to their place of origin once product is removed from the rack for repeated use. Shipping the rack back to is origin is expensive due to the weight of the rack.

Specially designed dunnage or support structures are manufactured for use with a particular size open steel frame of a rack. As a result, a steel rack used to ship one part may not readily be reused to ship a different part. Therefore, existing steel racks do not provide ready flexibility for reuse. If the specific part for which the rack is designed becomes obsolete or is not longer used, the rack may be essentially worthless.

Another drawback with steel racks is that they are susceptible to rust if left in moist conditions for any length of time. Therefore, a stored rack may be aesthetically unattractive even if it is able to be reused.

Another known type of shipping container illustrated in FIG. 1 is a four sided vertical dispensing container in which one of four sides is cut off or removed to convert the vertical dispensing container to a horizontal dispensing container. In the modified container, each of the three generally planar walls is made of injection molded plastic approximately two inches (50.8 mm) thick. Each of the walls is hingedly joined to a vertical wall portion of an injection molded base. A generally rectangular frame is secured to two opposed upstanding walls to provide an open fourth side of the container through which products may be horizontally dispensed. Dunnage is often located in the container to support parts inside the container which may be removed through the open fourth side in a substantially horizontal manner. A cover is often placed over the three sided modified horizontal dispensing container.

Although such modified containers have proven adequate for parts shipment, they too have various drawbacks. First, like the steel racks, such modified containers are heavy, which makes shipping and handling more difficult, dangerous and expensive. Assembly line workers are unable to move the heavy containers without a forklift. Often times, the weight of the modified container is far greater than the weight of the parts shipped therein. In such situations, a more lightweight, but structurally sound, shipping container in which the parts may be horizontally dispensed would be desirable.

Another drawback to these modified containers is that the injection molded walls only are available in a limited number of sizes. If a different size container is desired, the thick injection molded walls must be cut. This process is expensive, difficult and time consuming, if possible at all. Additionally, dunnage must be fitted inside the modified container to hold the specific parts being shipped.

Another drawback to these modified horizontal dispensing containers is that due to the thickness of the injection molded walls, when a rectangular frame is incorporated into the fourth side of the horizontal dispensing container, the open area of the fourth side is reduced. In other words, the thickness of the injection molded walls and/or frame limits the open area of the fourth side of the container through which parts are dispensed.

Another drawback to the use of these modified horizontal dispensing containers is that each manufacture of injection molded containers (before being modified) has a uniquely designed base and cover which are adapted to be stacked together. Again, however, they are not always compatible with bases and tops made by other manufacturers. Therefore, a user may be limited to one container manufacturer if the user wishes to be able to stack these injection molded containers.

Another drawback to the use of these modified horizontal dispensing containers is that the uniquely designed base and cover of injection molded containers (before being modified) are unable to be stacked with conventional pallet bases and covers of other manufacturers. Therefore, an assembly line worker at an automobile manufacturer is unable to stack a pallet load such as totes placed on a pallet base and covered with a pallet cover on top a modified horizontal dispensing container or steel rack. Similarly, a modified horizontal dispensing container or steel rack may not be stacked on a pallet cover covering a stack of totes.

Accordingly, there is a need for a lightweight horizontal dispensing container which may be used in connection with pallet bases and covers for stacking purposes.

There is further a need for a lightweight horizontal dispensing container which may quickly and easily be made to any desired height or size.

There is further a need for a lightweight horizontal dispensing container which provides a larger opening for dispensing parts secured in dunnage inside the container than heretofore known.

SUMMARY OF THE INVENTION

The present invention is directed to a stackable horizontal dispensing container which may incorporate any manufacturer's pallet base and pallet cover. One preferred embodiment of the stackable horizontal dispensing container comprises a pallet base, a pallet cover, a three sided plastic sleeve, a rectangular frame and dunnage inside the container to support product which may be removed horizontally, as opposed to vertically, from the container. If desired, the dunnage may be secured in any orientation to enable product to be removed as necessary.

The pallet base and pallet cover are preferably made of plastic but may be made of any material. They are manufactured to be stacked with other identical or similar pallet bases and/or covers. For example, a pallet base having multiple downwardly extending feet may be designed so that it may be stacked on top of a pallet cover.

In one preferred embodiment of the present invention, a piece of plastic is folded into a three sided sleeve before being secured to a generally rectangular frame and being sandwiched between a pallet base and pallet cover. The sleeve may be made of any desired height; and after being folded the three panels may be any desired height and/or length. Alternatively, the three-sided sleeve may be made by joining together multiple pieces of plastic by welding or any other suitable method. The plastic sleeve may be manufactured of corrugated plastic material known in the art. The corrugations may extend vertically or horizontally.

Alternatively, the sleeve may be made out of plastic material comprising two generally planar face plies and a middle ply having a plurality of dimples, the middle ply being sandwiched between the face plies. This type of plastic material is known in the industry as CON-PEARL®. The plastic material of the sleeve may be any thickness, but is preferably less than 20 millimeters thick. In one preferred embodiment, the thickness of the plastic sleeve is ten millimeters. Although plastic is one preferred material, the sleeve may be made of any suitable material.

The rectangular frame of the container is preferably made of metal, but may be made of any material. It is secured along two sides to the sleeve and may be additionally secured on the bottom and top to the pallet base and pallet cover, respectively. Depending on the size of the container, the rectangular frame may be made of any desired size. The generally rigid rectangular frame inhibits or restrains the container from shifting laterally, a movement known in the art as "racking". The rectangular frame provides stability to the container and defines an opening on a fourth side of the container through which product may be removed.

In one preferred embodiment of the present invention, fasteners extend through flutes in the corrugated plastic side walls of the sleeve, through the pallet base and pallet cover to secure the pallet base, pallet cover and sleeve together. Any number of fasteners may be used in this manner. Of course, any other manner of securing the pallet base and pallet cover to the sleeve may be utilized, as desired. For example, the fasteners may not extend through the pallet base and pallet cover.

Lastly, dunnage for supporting product is secured inside the horizontal dispensing container. The dunnage may comprise a product grid i.e. a plurality of intersecting partitions, a plurality of fabric pouches or any other supporting structure. Dunnage comprising intersecting partitions may include partitions made partly or entirely of fabric. If fabric pouches are utilized as the dunnage, they may be supported by the sleeve or frame in a manner like that disclosed in applicant's U.S. Pat. Nos. 5,725,119 and 6,062,410, both of which are fully incorporated herein. Alternatively, the pouches, or any dunnage used in accordance with the present invention, may be supported by the pallet cover, one or more braces, or opposed sides of the container.

One method of manufacturing this embodiment of the present invention comprises cutting a piece of plastic to the desired size and folding it to made a three sided sleeve. Alternatively, multiple pieces of plastic may be secured to each other to form the sleeve. The sleeve is then secured to a generally rectangular frame along the sides of the frame. The combination of sleeve and frame are then sandwiched between a pallet base and a pallet cover and secured thereto using fasteners or any other suitable method. Preferably, at least two sides of the sleeve abut the lips of the pallet base and pallet cover on the inside thereof. However, this feature of the present invention is not necessary; the sleeve may be located outside the lips of the pallet base and cover, if desired. Additionally, the generally rectangular frame may be located inside or outside the lips of the pallet base and pallet cover as desired.

The last step in manufacturing this embodiment of horizontal dispensing container is to secure dunnage inside the container for holding product such as automobile parts. The dunnage may be supported in any desired manner. For example, the dunnage may comprise vertical partitions supported from one or more braces at the top of the container or from the pallet cover. The dunnage need not be installed last; it may be incorporated into the horizontal dispensing container at any stage in the manufacturing process.

One advantage of the present invention is that a lightweight, stackable horizontal dispensing container may be quickly and easily manufactured using existing pallet systems, i.e. pallet cover and pallet bases. The horizontal dispensing container of the present invention may be stacked above or below pallet loads utilizing the same or similar types of pallet bases and covers. In this manner, a horizontal dispensing container may be integrated into a stack of pallet loads. An assembly line worker may stack an emptied horizontal dispensing container on top of pallet loads to conserve floor space after parts have been removed from the horizontal dispensing container.

The present invention provides a horizontal dispensing container which is lightweight enough that an assembly line worker may be able to manually move the container without a forklift. Another advantage of the present invention is that a stackable horizontal dispensing container may be manufactured more quickly and less expensively than is presently possible in other horizontal dispensing containers.

An alternative preferred embodiment of the present invention incorporates two rectangular frames into a lightweight, stackable horizontal dispensing container. The other two sides of the container comprise opposed side walls which may be any desired size and may be secured to the frames in any desired manner. These sidewalls may be made of corrugated plastic, CON-PEARL® or any other suitable material. The thickness of these side walls is preferably less than 20 millimeters, but may be any desired thickness.

The other two sides of this embodiment of horizontal dispensing container each comprise a generally rectangular frame which provides access inside the container. Each frame is preferably made of metal, but may be made of any suitably rigid material. Dunnage adapted to support multiple parts may be located inside the container, as with the embodiment described above. Thus, with this embodiment, an assembly line worker may access parts inside the container through either of two opposite sides of the container.

Another alternative preferred embodiment of the present invention is a lightweight, stackable horizontal dispensing container comprising two opposed side walls joined together with at least one brace. The side walls may be made out of plastic material such as corrugated plastic, CON-PEARL® or any other suitable material. Again, the thickness of each side wall is preferably less than 20 millimeters, but may be any desired thickness. Each of the side walls is folded or bent to form part of a rear wall of the container. A gap exists in the rear wall between the bent side walls in this embodiment. The front side of the container comprises a generally rectangular frame preferably made of metal. Dunnage adapted to support multiple parts may be located inside the container, as with any of the preferred embodiments described above. Again, this embodiment may enable an assembly line worker to access parts inside the container through either the front or rear sides.

In any of the preferred embodiments having at least two walls of corrugated plastic, fasteners may extend through flutes in the corrugated plastic walls of the container, through the pallet base and pallet cover to secure the pallet base, pallet cover and side walls together. Alternatively, any type of fasteners may be incorporated into any of the preferred embodiments of the present invention to secure the pallet base and pallet cover to the side walls or sleeve of the horizontal dispensing container of the present invention.

Similarly, braces may be used to stabilize any of the preferred embodiments of the present invention. The braces may extend from side to side or from back to front depending upon the desired application. Dunnage in any desired form may be partly or entirely supported from one or more of such braces.

BRIEF DESCRIPTION OF THE DRAWINGS

The objectives and features of the present invention will become more readily apparent when the following detailed description of the drawings is taken in conjunction with the accompanying drawings in which.

DETAILED DESCRIPTION OF THE DRAWINGS

Figure 1:
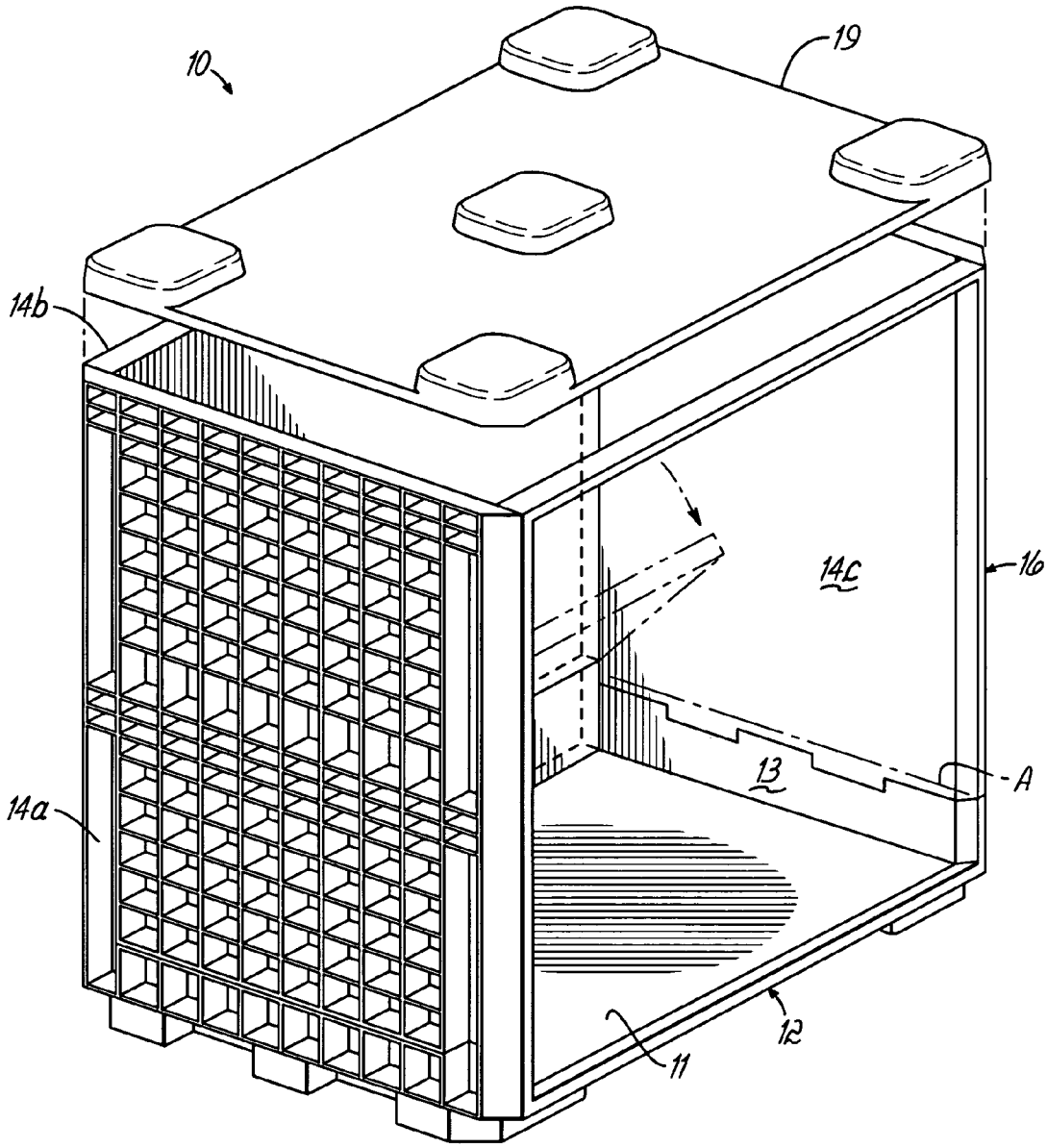
PRIOR ART FIG. 1
FIG. 1 is a perspective view of a prior art horizontal dispensing container.

Referring to FIG. 1, there is illustrated a prior art horizontal dispensing container 10 comprising an injection molded base 12 having three vertically oriented wall portions 13 extending upwardly from the perimeter of a bottom portion 11, three upstanding injection molded walls 14*a*, 14*b*, and 14*c* hingedly secured to the vertical wall portions 13 of the base 12 and a generally rectangular frame 16 on a fourth side of the container 10 which is secured to two of the upstanding injection molded walls 14*a* and 14*c*. Each of the injection molded walls 14*a*, 14*b* and 14*c* is formed as a generally rectangular piece and hingedly joined to the vertical wall portions 13 of the base 12 along a horizontal axis A (only one being shown) as much as 8-12 inches above the bottom portion 11 of the base 12 so they may collapse if desired. See FIG. 1. Each of the injection molded walls 14*a*, 14*b* and 14*c* is at a minimum approximately two inches (50.8 millimeters) thick. A cover 19 is removably secured on top of the container walls 14*a*, 14*b* and 14*c* and generally rectangular frame 16.

This horizontal dispensing container 10 is converted from a vertical dispensing container to a horizontal dispensing container by cutting off a portion of the base 12, removing one of the injection molded walls (not shown) and securing the rectangular frame 16 to two opposed injection molded walls 14*a*, 14*c* before the cover is 19 is placed over the container 10.

This prior art horizontal dispensing container 10, although illustrated with no dunnage inside has been used with fabric pouches or other forms of dunnage inside to separate and store parts or product.

Due primarily to the thickness of the injection molded plastic base and side walls, this modified horizontal dispensing container 10 is heavy, which makes shipping parts therein expensive. The weight of the modified horizontal dispensing container 10 also prohibits moving and/or stacking the container without assistance of a forklift. Due to the unique configuration of the cover 19 and injection molded base 12, such containers may only be stacked with similar containers. They may not be stacked with pallet loads including pallet bases and covers manufactured by other manufacturers. Additionally, the manufacturing cost associated with converting such a vertical dispensing container to a horizontal dispensing container may inhibit widespread use of these prior art containers.

Figure 2:
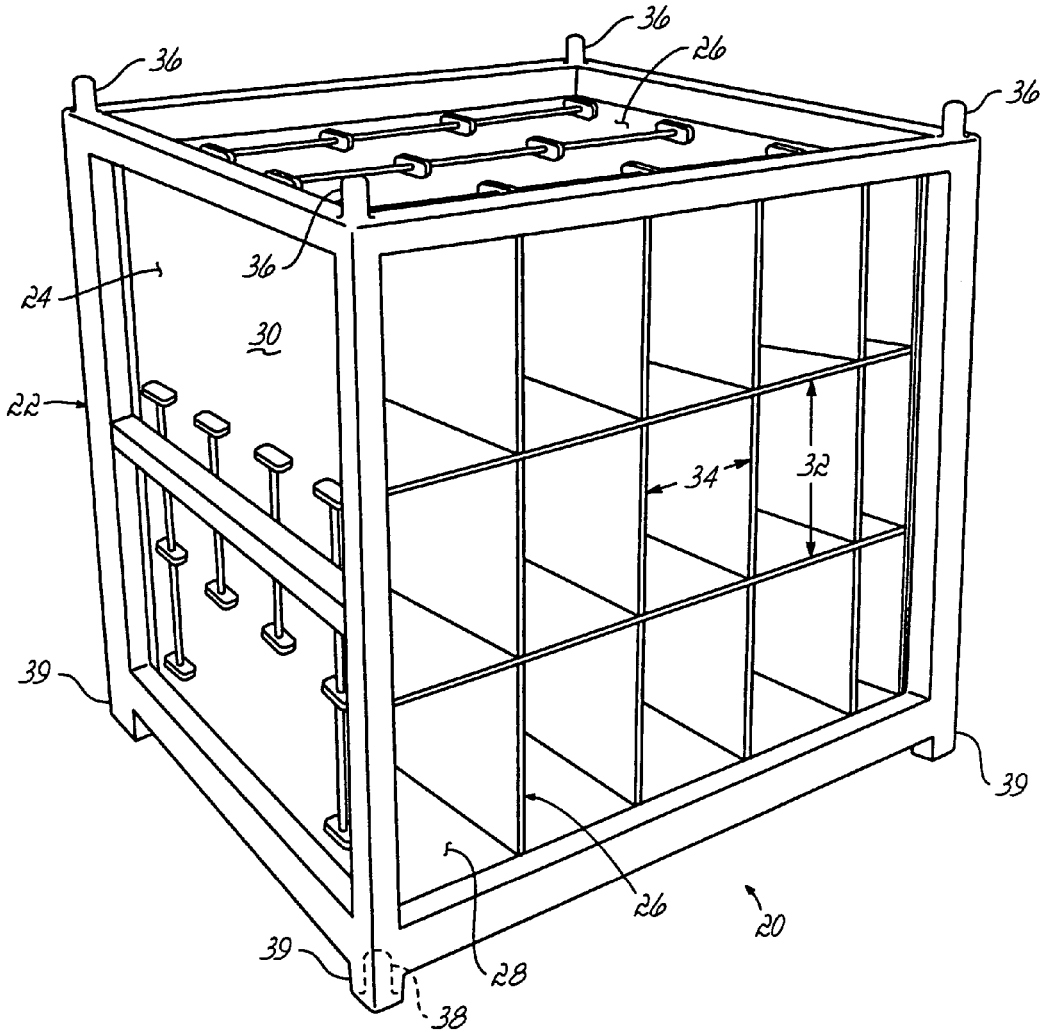
PRIOR ART FIG. 2
FIG. 2 is a perspective view of another prior art horizontal dispensing container known in the industry as a rack.

FIG. 2 illustrates another prior art horizontal dispensing container 20, known in the industry as a steel rack structure or container. The container 20 comprises an open steel rack or frame 22, outer container walls 24 and dunnage 26 secured to the outer container walls 24. The outer container walls 24 include a top wall 26, a bottom wall 28 and three side walls 30. Horizontal partitions 32 are secured to and extend between the side walls 30. These horizontal partitions 32 intersect with vertical partitions 34 secured to and extending between the top and bottom walls 26, 28. Together, the horizontal and vertical intersecting partitions 32, 34 form a grid in which are located parts (not shown).

Prior art horizontal dispensing containers like that shown in FIG. 2 may be stackable only with identical containers due to the unique configuration of the steel rack. More particularly, each steel rack 22 has four upwardly directed studs 36 which are sized to fit inside receptacles 38 (only one being shown) in four legs 40 of another identical rack (not shown).

Due primarily to the weight of the steel frame 22, this prior art horizontal dispensing container 20 is heavy, which makes shipping parts therein expensive. The weight also prohibits moving and/or stacking the container without assistance of a forklift. Due to the unique configuration of the steel frame 22 and particular the studs and legs thereof, such containers may only be stacked with similar containers. They may not be stacked with pallet loads including pallet bases and covers or with modified containers like those illustrated in FIG. 1 and described above.

Figure 3:
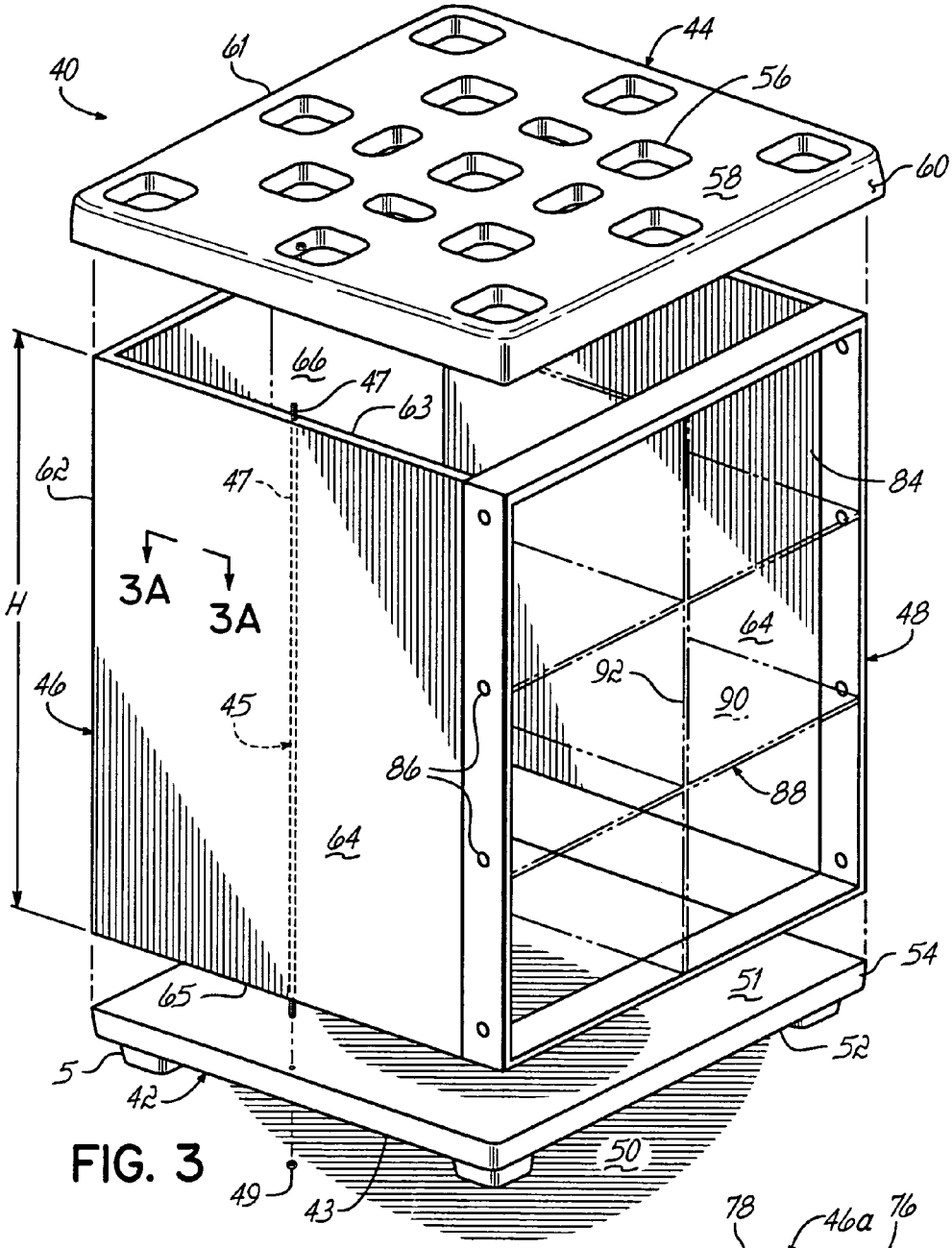
FIG. 3 is a perspective view, partially disassembled, of one preferred embodiment of the stackable horizontal dispensing container of the present invention.

Referring to FIG. 3, there is illustrated a lightweight, stackable horizontal dispensing container 40 according to one embodiment of the present invention. The container 40 comprises a pallet base 42; a pallet cover 44; a three sided sleeve 46 and a generally rectangular frame 48.

The pallet base 42 and pallet cover 44 comprise a pallet system which is stackable with similar pallet bases and covers. More particularly, the pallet base 42 may be supported by a floor or base 50 or stacked on a pallet cover made by the same manufacturer of pallet systems. See FIG. 5. Referring back to FIG. 3, the pallet base 42 has a main body 43 having an upper surface 51 and a lower or bottom surface 52 having a unique configuration or pattern including feet 5 which enables the pallet base 42 to be stacked only with a pallet cover made by the same manufacturer and/or having a corresponding mating pattern or configuration. The pallet base 42 has a lip 54 extending around the periphery of the body 43 of the pallet base 42 and extending upwardly therefrom. The lip 54 of the pallet base 42 is adapted to surround the sleeve 46 and frame 48 of the container 40 and help prevent the pallet base 42 from sliding off the container 40 and becoming separated therefrom. If desired, fasteners may be used to secure walls of the sleeve 46 inside the lip 54 of the pallet base 42.

Similarly, the pallet cover 44 may be supported by the sleeve 46 and frame 48 in a manner shown in FIG. 3 and is configured to receive in a stackable manner a pallet base thereon made by the same manufacturer of pallet systems and/or having a mating corresponding pattern or footprint. See FIG. 4. The pallet cover 44 has a unique configuration, footprint or pattern 56 on the upper surface 58 thereof which enables a pallet base 42 having a matching configuration or pattern on the lower surface 52 thereof to be stacked thereon. The pallet cover 44 has a lip 60 extending around the periphery of a main body 61 of the pallet cover 44 and extending downwardly therefrom. The lip 60 of the pallet cover 44 is adapted to surround the sleeve 46 and frame 48 of the container 40 and help prevent the pallet cover 44 from sliding off the container 40 and becoming separated therefrom. If desired, fasteners may be used to secure walls of the sleeve 46 inside the lip 60 of the pallet cover 44.

The pallet base 42 and pallet cover 44 are preferably made of injection molded plastic or vacuum formed plastic but may be made of any suitable material. The pallet base 42 and pallet cover 44 may be different configurations or designs; alternatively, they may be mirror images of one another.

The sleeve 46 is assembled from a uniform thickness sleeve blank (not shown) which is die cut or otherwise pre-cut from, preferably, corrugated plastic sheet. The blank has an upper edge 63 and a lower edge 65, the distance therebetween defining a height H of the sleeve 46. In one preferred embodiment, the sleeve or piece of plastic material 46 is folded along vertical fold lines 62 to made two side walls 64 and a rear wall 66. However, the resulting sleeve may be made from any other suitable material. In another preferred embodiment, the sleeve 46 is made from multiple pieces of plastic welded or otherwise secured together.

Figure 3A:
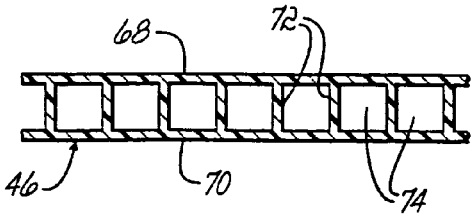
FIG. 3A is a cross-sectional view taken along the line 3A-3A of FIG. 3.

FIG. 3A illustrates a cross section of sleeve 46 in which the sleeve is made of plastic corrugated material, the corrugations extending vertically. Vertically oriented corrugations provide stacking strength. If desired, the corrugations may extend horizontally. As shown in FIG. 3A, the plastic material of the sleeve 46 comprises a pair of generally planar face plies, an inner face ply 68 and a outer face ply 70. A plurality of vertically oriented corrugations or partitions 72 extending between the inner and outer plies 68, 60 define a plurality of channels or flutes 74.

Figure 3B:
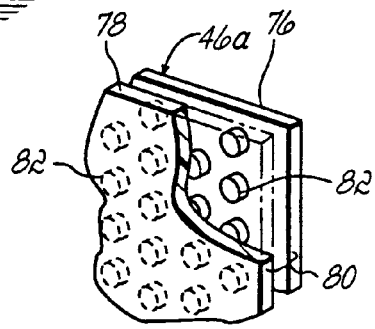
FIG. 3B is a partial perspective view taken of an alternative material for the sleeve.

FIG. 3B illustrates another type of plastic material from which the sleeve 46 may be made in an alternative embodiment of the present invention. This plastic material is known in the industry as CON-PEARL®. As shown in FIG. 3B, this plastic material comprises a pair of generally planar face plies, an inner face ply 76 and a outer face ply 78. A middle ply 80 having a plurality of dimples 82 punched therein is sandwiched between the inner and outer face plies 76, 78 and secured thereto. The dimples 82 extend between the inner and outer plies 76, 78.

The plastic material from which the sleeve is made is preferably less than 20 millimeters thick, and in one preferred embodiment is ten millimeters thick and made from extruded corrugated plastic material. Depending upon the application, the sleeve blank may be other thicknesses or materials as well. In any of the embodiments of the present invention, if the corrugations of the sleeve are oriented vertically, the corrugations provide additional stacking strength to the container.

As best illustrated in FIG. 3, the horizontal dispensing container 40 further comprises generally rectangular frame 48. The frame 48 has an open interior 84. The frame 48 is located on a fourth side of the container 40 and is secured with fasteners 86 to the side walls 64 of the three sided sleeve 46. However, any other method of securing the rectangular frame 48 to the side walls 64 of the three sided sleeve 46 such as ultasonic welding or gluing may be used if desired. The generally rectangular frame 48 is preferably made of metal but may be made of any other material. The generally rectangular frame 48 provides rigidity to the container 40 and prevents movement known in the industry as "racking" which is a shifting of the sides of the container.

As best illustrated in FIG. 3, the horizontal dispensing container 40 further comprises fasteners 45 (only one being shown) which secure the sleeve 46 to the pallet base 42 and pallet cover 44. The fasteners 45 extend through the flutes 74 of the corrugated plastic sleeve 46. In one preferred embodiment, each fastener 45 includes a threaded rod 47 and a pair of nuts 49 adapted to engage the threaded rod 47 in a conventional manner. Any other types of fasteners may be used to secure the pallet base, pallet cover and sleeve together.

Figure 4:
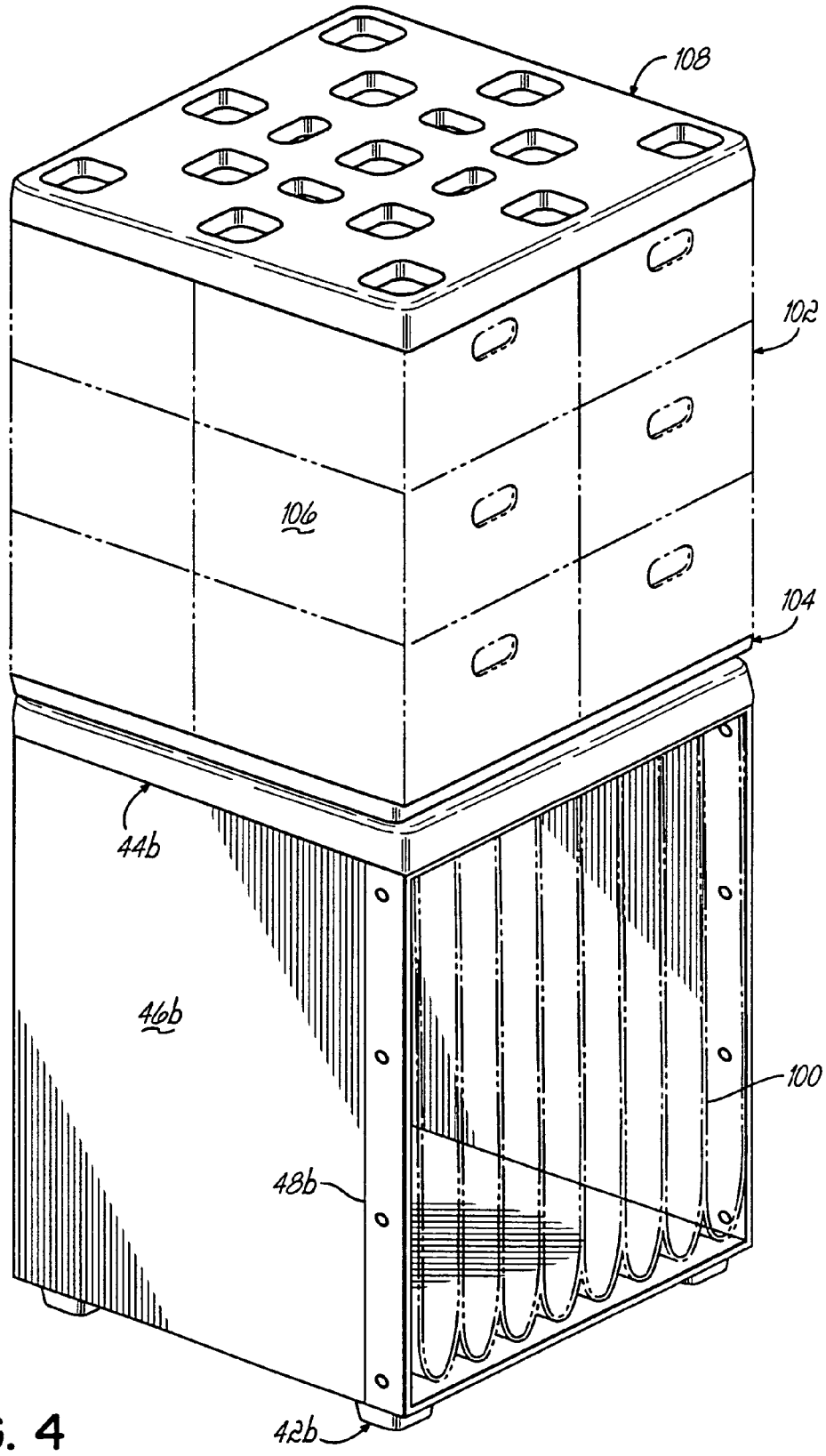
FIG. 4 is a perspective view of one preferred embodiment of the stackable horizontal dispensing container of the present invention upon which is stacked a load of totes.

As shown in FIG. 3, the container 40 further comprises dunnage 88 comprising a matrix of partitions. The matrix or grid comprises a plurality of parallel horizontal partitions 90 which are secured to and extend between the side walls 64 of the sleeve 46. These horizontal partitions 90 intersect with a vertical partition 92 secured to and extending between the generally rectangular frame 48 and the rear wall 66 of the sleeve 46. The horizontal and vertical partitions, 90,92 may be secured to the sleeve 46 in any suitable manner. Similarly, although only one vertical partition 92 and two horizontal partitions 90 are illustrated, any number of horizontal or vertical partitions may be used in accordance with the present invention. Together, the horizontal and vertical intersecting partitions 90, 92 form a grid in which are located parts (not shown). Although FIG. 3 illustrates the dunnage 88 being a partition grid or matrix, the container 40 of FIG. 3 may be used with any other type or form of dunnage such as pouches as shown in FIG. 4 to contain parts or product.

Figure 3C:
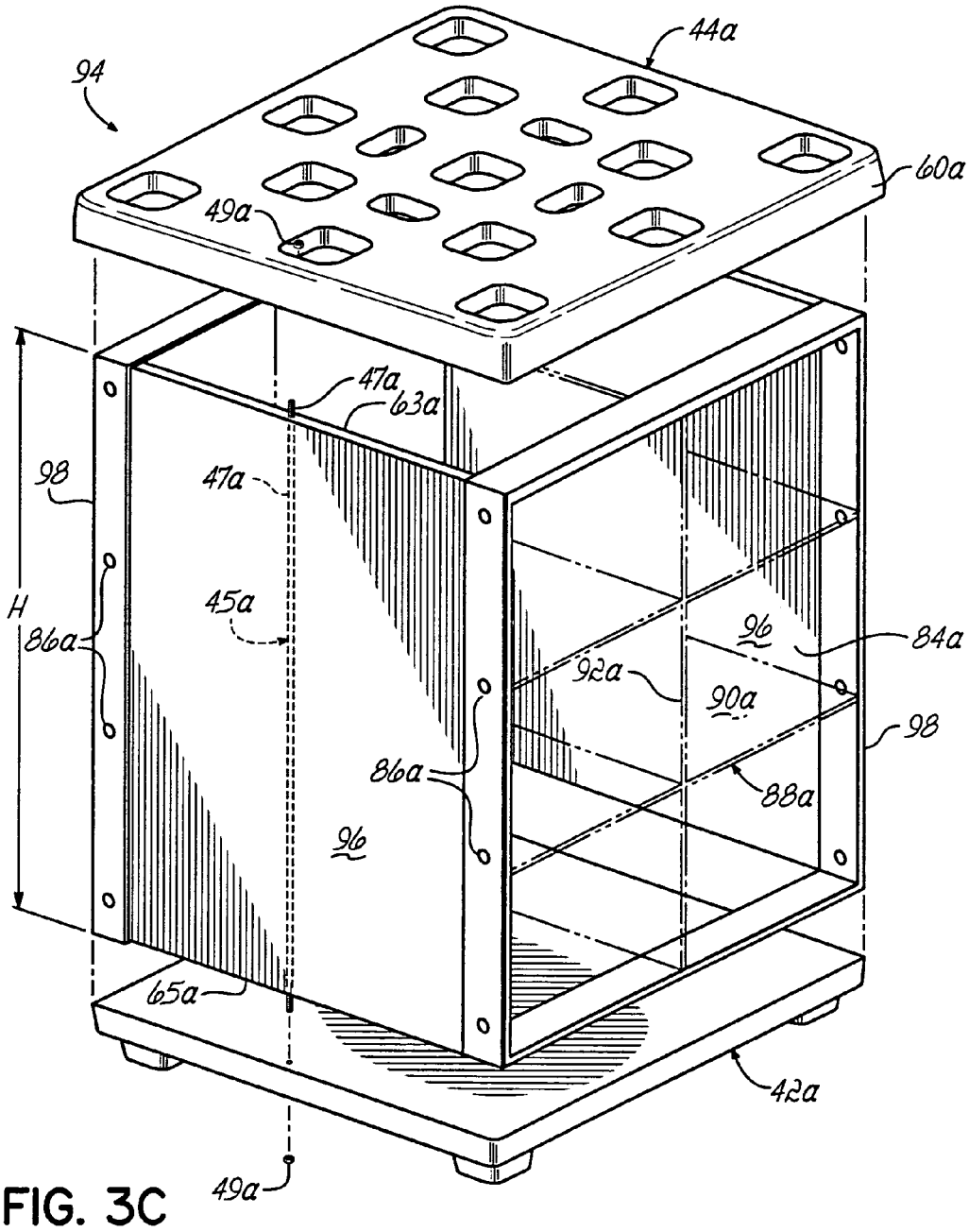
FIG. 3C is a perspective view, partially disassembled, of another preferred embodiment of the stackable horizontal dispensing container of the present invention.

An alternative preferred embodiment of the present invention is illustrated in FIG. 3C. For the sake of simplicity, like numerals will be used to describe like parts but with a letter "a" designation. In this preferred embodiment, two sides of the container rather than one side are open to enable an assembly line worker or any person to access parts or product in the container. FIG. 3C illustrates a lightweight, stackable horizontal dispensing container 94 comprising a pallet base 42*a*, a pallet cover 44*a*, two generally rectangular side pieces, plates, panels or walls 96 on opposite sides of the container 94 and two generally rectangular frames 98 on opposite sides of the container 94.

The side walls 96 are preferably made of plastic, either corrugated or CON-PEARL®, but may be made of any material. Each side wall 96 has an upper edge 63*a* and a lower edge 65*a*, the distance therebetween defining a height H of the side wall 96. Each side wall 96 is preferably less than 20 millimeters thick, and in one preferred embodiment is ten millimeters thick and made from extruded corrugated plastic material. Depending upon the application, the side walls 96 may be other thicknesses or materials as well. In any of the embodiments of the present invention, if the corrugations of the side walls are oriented vertically, the corrugations provide additional stacking strength to the container.

Each generally rectangular frame 98 has an open interior 84*a*. Each frame 98 is secured with fasteners 86*a* to the side walls 96. However, any other method of securing the rectangular frames 98 to the side walls 96 such as ultasonic welding or gluing may be used if desired. Each generally rectangular frame 98 is preferably made of metal, but may be made of any other material. The generally rectangular frames 98 provide rigidity to the container 94 and prevents movement known in the industry as "racking" which is a shifting of the sides of the container 94.

As best illustrated in FIG. 3, the horizontal dispensing container 94 further comprises fasteners 45*a* (only one being shown) which secure the side walls 96 to the pallet base 42*a* and pallet cover 44*a*. The fasteners 45*a* extend through the flutes 74*a* of the corrugated plastic side walls 96. In one preferred embodiment, each fastener 45*a* includes a threaded rod 47*a* and a pair of nuts 49*a* adapted to engage the threaded rod 47*a* in a conventional manner. Any other types of fasteners may be used to secure the pallet base, pallet cover and sleeve together.

As best illustrated in FIG. 3C, the stackable horizontal dispensing container 94 further comprises dunnage 88*a* comprising a matrix of partitions. The matrix or grid comprises a plurality of parallel horizontal partitions 90*a* which are secured to and extend between the side walls 96 of the container 94. These horizontal partitions 90*a* intersect with a vertical partition 92*a* extending between the generally rectangular frames 98. The horizontal partitions 90*a* may be secured to the side walls 96 in any suitable manner. Similarly, although only one vertical partition 92*a* and two horizontal partitions 90*a* are illustrated, any number of horizontal or vertical partitions may be used in accordance with the present invention. Together, the horizontal and vertical intersecting partitions 90, 92 form a grid in which are located parts (not shown). The vertical partition 92*a* may be secured to the generally rectangular frames 98 or to the horizontal partitions 90*a*, if desired. Together, the horizontal and vertical intersecting partitions 90*a*, 92*a* form a grid in which are located parts (not shown). Although the dunnage 88*a* illustrated in FIG. 3C is a partition grid or matrix, the container 94 of FIG. 3C may be used with any other type or form of dunnage such as pouches as shown in FIG. 4.

The method of manufacturing the lightweight, stackable horizontal dispensing container 40 illustrated in FIG. 3 and described above comprises the following steps. First, a piece of material or blank, preferably plastic, is folded into a three sided sleeve 46. The generally rectangular frame 48 is secured to two opposed sides or walls of the sleeve 46. The combination of frame 48 and sleeve 46 is then placed on top of the pallet base 42 and covered with the pallet cover 44. The dunnage 88 is then secured inside the container 40. Alternatively, the dunnage 88 may be secured to the sleeve 46 and/or frame 48 prior to the pallet base 42 and pallet cover 44 being added. Lastly, fasteners 45 secure the ballet base 42, pallet cover 44 and sleeve 46 together.

FIG. 4 illustrates an alternative preferred embodiment of the present invention like the embodiment illustrated in FIG. 3, but with different dunnage. For the sake of simplicity, where possible, like numbers will be used for like parts, but the letter designation "b" will be used to describe this preferred embodiment. FIG. 4 illustrates an assembled lightweight, stackable horizontal dispensing container 40*b* comprising a pallet base 42*b*; a pallet cover 44*b*; a three sided sleeve 46*b* and a generally rectangular frame 48*b*. Inside the container 40*b* are a plurality of fabric pouches 100 each being generally U-shaped. The pouches 100 are sized and configured to receive relatively large parts, such as automobile doors, for example. The pouches 100 may be suspended from the pallet cover 44*a*, the sleeve 46*b*, frame 48*b* or from some other structure located between the pallet cover 44*a* and the remainder of the horizontal dispensing container 40*b*.

FIG. 4 illustrates a pallet load 102 stacked on top of the horizontal dispensing container 40*b*. The pallet load 102 comprises a pallet base 104 identical to the pallet base 42*b* of the horizontal dispensing container 40*b*; a plurality of tote boxes 106 and a pallet cover 108 identical to the pallet cover 44*b* of the horizontal dispensing container 40*b*. Although six tote boxes 106 are illustrated, any number of tote boxes or other type of container may comprise the pallet load 102. The pallet load 102 need not comprise tote boxes sandwiched between a pallet base and pallet cover; any other type of load may be sandwiched therebetween.

Although FIG. 4 illustrates one pallet load 102 stacked on top of one horizontal dispensing container 40*b*, any number of pallet loads and/or horizontal dispensing containers may be stacked upon one another using the present invention. Alternative embodiments of the horizontal dispensing container of the present invention, such as the embodiment illustrated in FIG. 3C and described above may be stacked in the same manner. Again, the unique configuration or pattern of a pallet set (cover and base) enable a pallet base to stacked upon a pallet cover in a sturdy, reliable manner. Prior to the present invention, pallet loads could not be stacked with horizontal dispensing containers such as racks.

Figure 5:
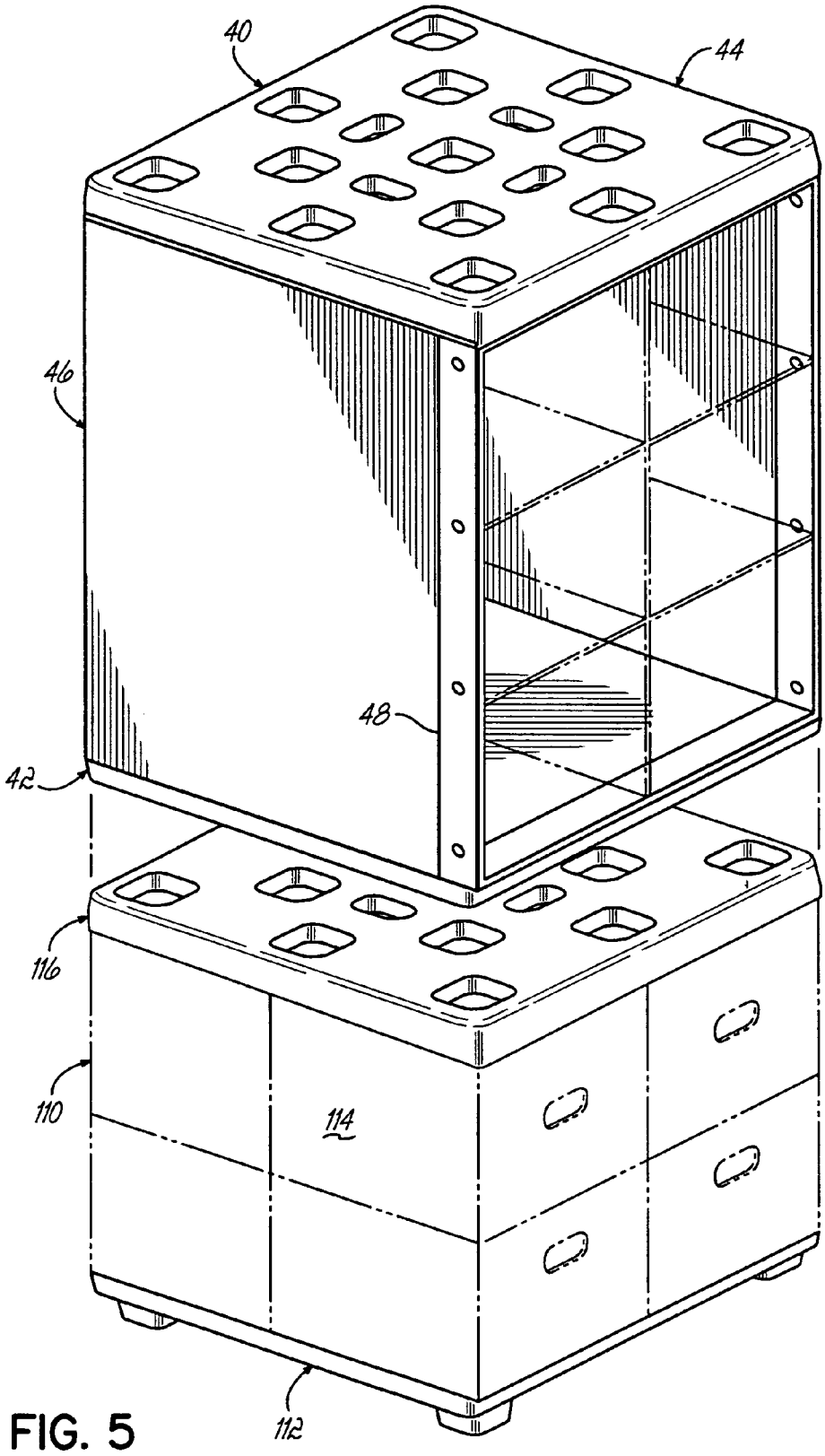
FIG. 5 is a perspective view of another preferred embodiment of the stackable horizontal dispensing container of the present invention stacked on top of a load of totes.

FIG. 5 illustrates the preferred embodiment of the present invention illustrated in FIG. 3 and described above stacked on top of a pallet load 110. FIG. 5 illustrates an assembled lightweight, stackable horizontal dispensing container 40 comprising a pallet base 42; a pallet cover 44; a three sided sleeve 46 and a generally rectangular frame 48. Inside the horizontal dispensing container 40 is dunnage 88 as described above. However, pouches or any other form of dunnage may be used if desired.

FIG. 5 illustrates the horizontal dispensing container 40 stacked on top of a pallet load 110. The pallet load 110 comprises a pallet base 112 identical to the pallet base 42 of the horizontal dispensing container 40; a plurality of tote boxes 114 and a pallet cover 116 identical to the pallet cover 44 of the horizontal dispensing container 40. Although eight tote boxes 114 are illustrated, any number of tote boxes may comprise the pallet load 110. The pallet load 110 need not comprise tote boxes sandwiched between a pallet base and pallet cover; any other type of load may be sandwiched there between.

Although FIG. 5 illustrates one horizontal dispensing container 40 stacked on top of one pallet load 110, any number of pallet loads and/or horizontal dispensing containers may be stacked upon one another using the present invention. Alternative embodiments of the horizontal dispensing container of the present invention, such as the embodiments illustrated in FIG. 3C or FIG. 4 and described above may be stacked in the same manner. Again, the unique configuration or pattern of a pallet set (cover and base) enable a pallet base to stacked upon a pallet cover in a sturdy, reliable manner. Again, before the present invention, pallet loads could not be stacked with horizontal dispensing containers such as racks.

Figure 6:
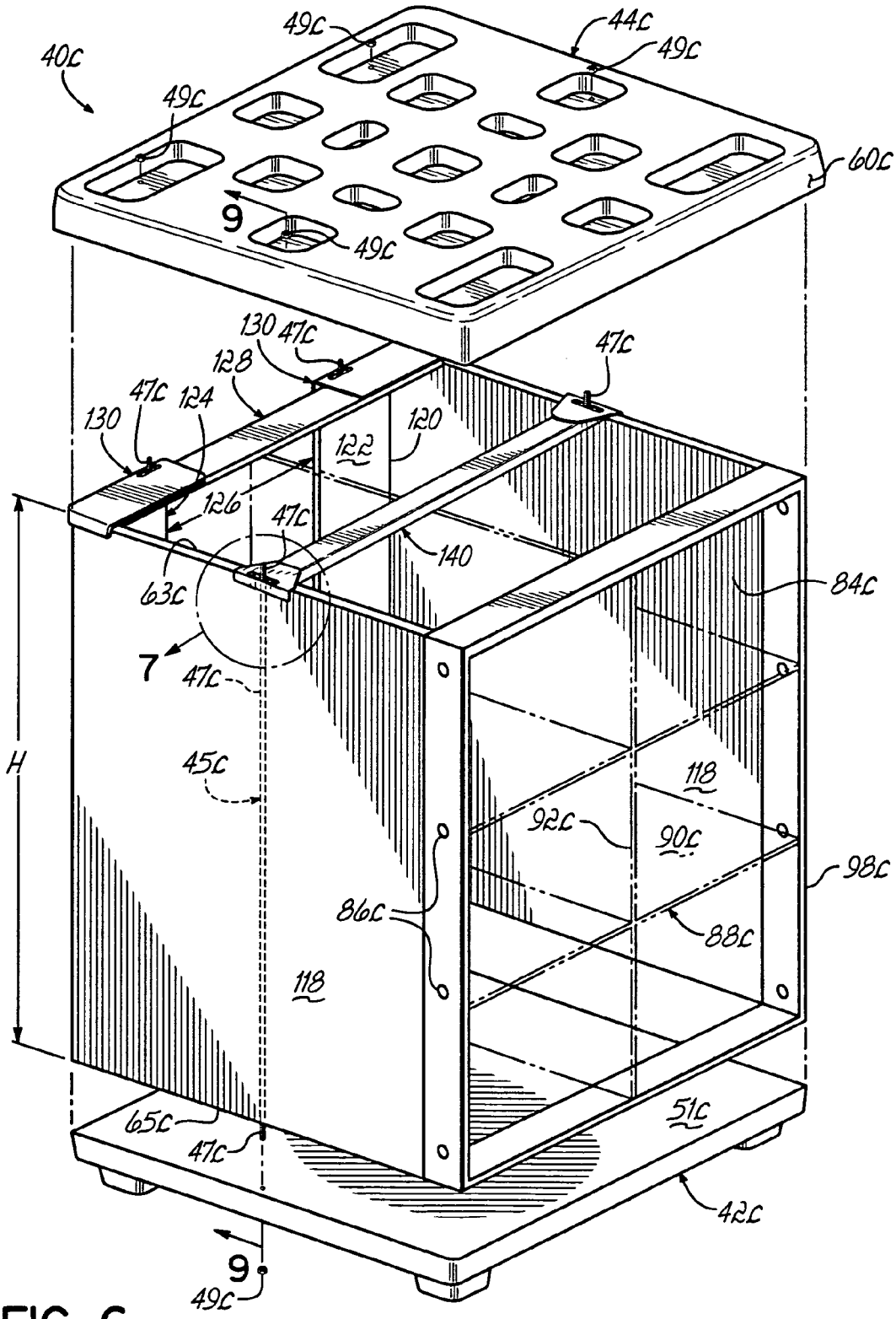
FIG. 6 is a perspective view, partially disassembled, of another preferred embodiment of the stackable horizontal dispensing container of the present invention.

An alternative preferred embodiment of the present invention is illustrated in FIG. 6. For the sake of simplicity, like numerals will be used to describe like parts but with a letter "c" designation. In this preferred embodiment, two sides of the container rather than one side are open to enable an assembly line worker or any person to access parts or product in the container. FIG. 6 illustrates a lightweight, stackable horizontal dispensing container 40*c* comprising a pallet base 42*c*, a pallet cover 44*c*, two generally rectangular side pieces, panels or walls 118 on opposite sides of the container 40*c* and a generally rectangular frame 98*c* on one side of the container 94.

The side walls 118 are preferably made of plastic, either corrugated or CON-PEARL®, but may be made of any material. Each side wall 118 has an upper edge 63*c* and a lower edge 65*c*, the distance therebetween defining a height H of the side wall 118. Each side wall 118 is preferably less than 20 millimeters thick, and in one preferred embodiment is ten millimeters thick and made from extruded corrugated plastic material. Depending upon the application, the side walls 118 may be other thicknesses or materials as well.

As shown in FIG. 6, each side wall 118 is folded along fold line 120 so that a portion 122 of the side wall 118 forms part of a rear wall 124. However, a gap 126 exists between the portions 122 in the rear wall 124 which allows access to the interior of the container 40*c* through the rear wall 124.

The generally rectangular frame 98*c* has an open interior 84*c*. Frame 98*c* is secured with fasteners 86*c* to the side walls 118. However, any other method of securing the rectangular frame 98 to the side walls 118 such as ultasonic welding or gluing may be used if desired. The generally rectangular frame 98*c* is preferably made of metal, but may be made of any other material. The generally rectangular frame 98*c* provides rigidity to the container 94 and prevents movement known in the industry as "racking" which is a shifting of the sides of the container 40*c*.

Figure 9:
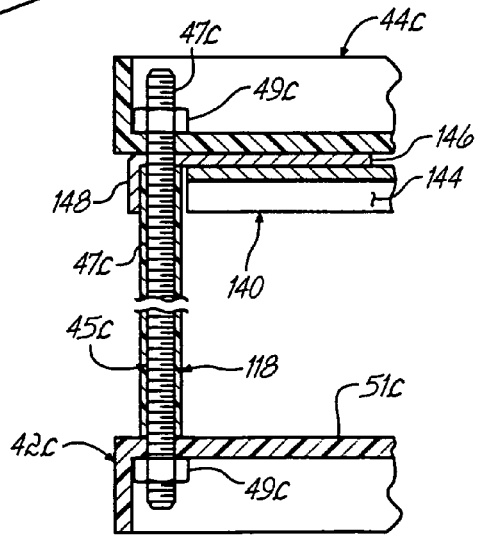
FIG. 9 is a cross-sectional view taken along the line 9-9 of FIG. 6 but with the stackable horizontal dispensing container assembled.

As best illustrated in FIGS. 6 and 9, the horizontal dispensing container 40*c* further comprises fasteners 45*c* (only one being shown) which secure the side walls 118 to the pallet base 42*c* and pallet cover 44*c*. The fasteners 45*c* extend through the flutes 74*c* of the corrugated plastic side walls 118. In one preferred embodiment, each fastener 45*c* includes a threaded rod 47*c* and a pair of nuts 49*c* adapted to engage the threaded rod 47*c* in a conventional manner. Any other types of fasteners may be used to secure the pallet base, pallet cover and sleeve together.

Figure 8:
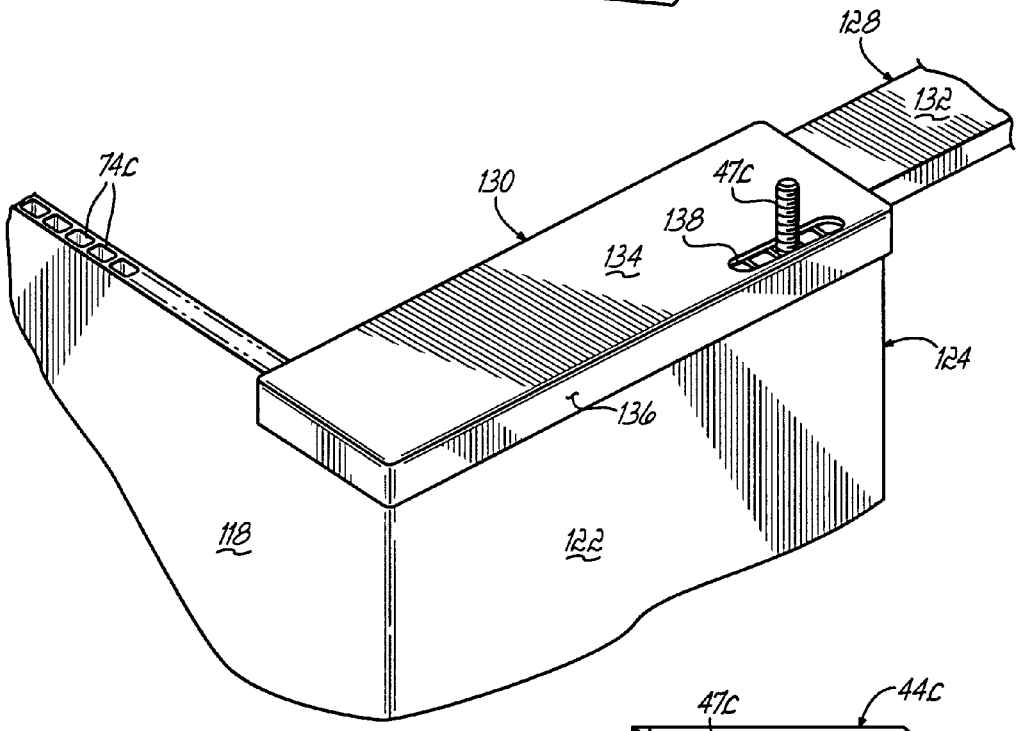
FIG. 8 is an enlarged rear perspective view of a rear corner of the stackable horizontal dispensing container of FIG. 6.

As shown in FIG. 8, a rear brace 128 having a pair of opposed end portions 130 and a middle portion 132 therebetween comprises part of the container 40*c*. Each end portion 130 has a main portion 134 which rests on top of the side and rear walls 118, 124 of the container 40*c* and a lip 136 which extends downwardly from the main portion 134. The lip 136 fits around the exterior of the container 40 and more specifically around the side and rear walls 118, 124 of the container 40*c* as shown in FIG. 8. The end portion 130 has at least one hole or opening 138 (only one being shown) therein through which passes threaded rod 47*c*. Although one configuration of rear brace 128 is illustrated and described other configurations or types of braces may be used in accordance with the present invention.

Figure 7:
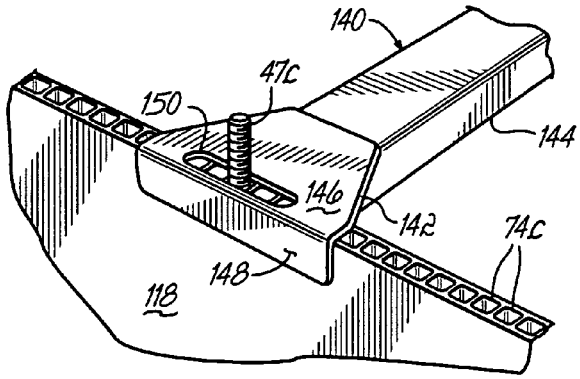
FIG. 7 is an enlarged view of the encircled area 7 of FIG. 6.

FIG. 7 illustrates a middle brace 140 having a pair of opposed end portions 142 and a middle portion 144 therebetween comprises part of the container 40*c*. Each end portion 142 has a main portion 146 which rests on top of one of the side walls 118 of the container 40*c* and a lip 148 which extends downwardly from the main portion 146. The lip 148 fits outside of the exterior of the container 40*c* and more specifically outside the side wall 118 of the container 40*c* as shown in FIG. 7. The main portion 146 has at least one hole or opening 150 (only one being shown) therein through which passes threaded rod 47*c*. Although one configuration of middle brace 140 is illustrated and described other configurations or types of braces may be used in accordance with the present invention.

While I have described several preferred embodiments of the present invention, persons skilled in the art will appreciate changes and modifications which may be made without departing from the spirit of the invention. For example, although one configuration of dunnage is illustrated and described, the present invention may be used with other configurations of dunnage. Therefore, I intend to be limited only by the scope of the following claims and equivalents thereof:

I claim:

1. A stackable horizontal dispensing container comprising:

a pallet base;

a pallet cover;

a three sided sleeve being made of corrugated plastic having vertically oriented corrugations, the sleeve extending between the pallet base and the pallet cover, the sleeve, pallet base and pallet cover defining an interior of the horizontal dispensing container;

fasteners extending through a portion of the sleeve to secure the sleeve to the pallet base; and a rectangular frame having an open interior secured to opposed sides of the sleeve such that the rectangular frame defines an opening on a fourth side of the horizontal dispensing container wherein the sleeve is made of one piece of material.

2. The horizontal dispensing container of claim 1 further comprising dunnage inside the interior of the horizontal dispensing container.

3. The horizontal dispensing container of claim 2 wherein the dunnage comprises intersecting partitions.

4. The horizontal dispensing container of claim 2 wherein the dunnage comprises pouches.

5. The horizontal dispensing container of claim 1 wherein the rectangular frame is secured to the sleeve with fasteners.

6. The horizontal dispensing container of claim 1 wherein the frame is made of metal to provide rigidity to the container.

7. The horizontal dispensing container of claim 1 wherein a second pallet base substantially identical to the pallet base may be stacked on the pallet cover.

8. The horizontal dispensing container of claim 1 further comprising a brace extending between opposed sides of the sleeve.

9. The horizontal dispensing container of claim 1 wherein the sleeve is less than twenty millimeters thick.

10. A stackable horizontal dispensing container comprising:

a pallet base;

a three sided sleeve made of corrugated plastic having vertically extending corrugations defining a plurality of flutes, the sleeve being secured to the pallet base with fasteners extending through the flutes of the sleeve; and a frame having an open interior secured to opposed sides of the sleeve, the frame defining an opening on a fourth side of the horizontal dispensing container, whereby the container provides horizontal access to product residing in the interior of the container.

11. The horizontal dispensing container of claim 10 further comprising dunnage inside the interior of the horizontal dispensing container.

12. The horizontal dispensing container of claim 11 wherein the dunnage comprises intersecting partitions.

13. The horizontal dispensing container of claim 11 wherein the dunnage comprises pouches.

14. The horizontal dispensing container of claim 10 wherein the frame is rectangular.

15. The horizontal dispensing container of claim 10 wherein the frame is made of metal.

16. The horizontal dispensing container of claim 10 wherein the frame is secured to the sleeve with fasteners.

17. The horizontal dispensing container of claim 10 further comprising a brace extending between opposed sides of the sleeve.

18. A stackable horizontal dispensing container comprising:

a pallet base;

a sleeve made at least partially of corrugated plastic wherein the corrugations extend vertically;

a brace extending between opposed sides of the sleeve;

fasteners extending through a portion of the sleeve and the brace for securing the pallet base, the sleeve and the brace together;

a rectangular frame having an open interior secured to opposed sides of the sleeve such that the rectangular frame defines an opening on a side of the horizontal dispensing container.

19. The horizontal dispensing container of claim 18 further comprising dunnage inside the container.

20. The horizontal dispensing container of claim 19 wherein the dunnage comprises intersecting partitions.

21. The horizontal dispensing container of claim 19 wherein the dunnage comprises pouches.

22. The horizontal dispensing container of claim 18 further comprising a pallet cover.

23. A stackable horizontal dispensing container comprising:

a pallet base;

a sleeve made at least partially of corrugated plastic having vertically extending corrugations defining a plurality of flutes, the sleeve being secured to the pallet base with fasteners extending through the flutes of the sleeve; and a frame secured to opposed sides of the sleeve, the frame defining an opening on a fourth side of the horizontal dispensing container, whereby the frame has an open interior to provide horizontal access to product residing in the interior of the container.

24. The container of claim 23 further comprising dunnage inside the container.

25. The container of claim 24 wherein the dunnage comprises intersecting partitions.

26. The container of claim 24 wherein the dunnage comprises pouches.

27. The container of claim 24 further comprising a brace extending between opposed sides of the sleeve.

28. A stackable horizontal dispensing container comprising:

a pallet base;

a sleeve made at least partially of corrugated plastic having vertically extending corrugations defining a plurality of flutes, the sleeve being secured to the pallet base with fasteners extending through the flutes of the sleeve; and a metal frame secured to opposed sides of the sleeve with fasteners, the metal frame defining an opening on a fourth side of the horizontal dispensing container, whereby the frame has an open interior to provide horizontal access to product residing in the interior of the container.

29. The container of claim 28 further comprising a brace extending between opposed sides of the sleeve.

* * * * *